United States Patent [19]

Dillon

[11] 4,450,617

[45] May 29, 1984

[54] SYSTEM FOR AND ASSEMBLY OF A PREFABRICATED HOME MODULE

[75] Inventor: Thomas J. Dillon, Akron, Ohio

[73] Assignee: The Dillon Company, Akron, Ohio

[21] Appl. No.: 263,577

[22] Filed: May 14, 1981

[51] Int. Cl.[3] ..... B23P 11/00

[52] U.S. Cl. ..... 29/430; 52/745

[58] Field of Search ..... 52/79.1, 745; 29/430, 29/469

[56] References Cited

U.S. PATENT DOCUMENTS

| | | | |
|---|---|---|---|
| 3,225,434 | 12/1965 | Van Der Lely et al. | 29/430 |
| 3,574,920 | 4/1971 | Stirling | 29/430 |
| 3,805,365 | 4/1974 | Ashby | 29/430 |
| 3,958,320 | 5/1976 | Van Der Lely | 29/430 |
| 3,962,773 | 6/1976 | Van Der Lely | 29/430 |
| 3,994,060 | 11/1976 | Van Der Lely et al. | 29/430 |

FOREIGN PATENT DOCUMENTS

| | | | |
|---|---|---|---|
| 1010626 | 5/1977 | Canada | 52/79.1 |

*Primary Examiner*—John E. Murtagh
*Assistant Examiner*—Kathryn L. Ford
*Attorney, Agent, or Firm*—Oldham, Oldham, Hudak, Weber & Sand Co.

[57] ABSTRACT

A system for fabricating a prefabricated home module utilizing a truss floor system with integral duct work. The module is assembled on carriers which run along a pair of tracks. A plurality of carriers can be connected to form a train which is moved from one construction station to the next. The module and mating deck components are transported to a home site and installed. The system relates to the construction of a home or building, and to modules therefor which are easily assembled, produced under factory, quality controlled conditions, and are inexpensively made.

5 Claims, 5 Drawing Figures

SYSTEM FOR AND ASSEMBLY OF A PREFABRICATED HOME MODULE

TECHNICAL FIELD

The present invention relates to a system, as well as the assembly of a prefabricated home module on carriers residing upon a track and installing the floors, duct work, etc., at various stages along the track.

BACKGROUND ART

Heretofore, modular homes have been constructed utilizing individual modular units generally having walls about the entire perimeter thereof. The modules had floor joists, some had truss as floor supports, stud framing for the walls, and often contained electrical wiring and plumbing along with junctions for connection to adjacent modular units. Whenever joist construction was utilized, the home site required a footer and supporting posts and beams.

The above constructions fail to utilize a system wherein carriers are mounted on tracks, wherein jigs are utilized to correctly space the parallel floor truss, wherein ducts are installed within the truss network, and the like.

DISCLOSURE OF INVENTION

It is therefore an object of the present invention to provide, as well as a system for making, a prefabricated home module.

It is another object of the present invention to provide, as well as a system for making, a prefabricated home module, as above, wherein said module is built on a carrier which resides on a pair of tracks.

It is yet another object of the present invention to provide, as well a system for making, a prefabricated home module, as above, in which said module is initially built on a jig.

It is yet another object of the present invention to provide, as well as a system for making, a prefabricated home module, as above, wherein said module has a plurality of trusses as the floor and wall supports.

It is yet another object of the present invention to provide, as well as a system for making, a prefabricated home module, as above, wherein duct work is added and installed between the network of trusses.

It is yet another object of the present invention to provide, as well as a system for making, a prefabricated home module, as above, including adding a floor to the top of said trusses.

It is yet another object of the present invention to provide, as well as a system for making, a prefabricated home module, as above, in which said modules are moved from station to station along said tracks with generally a different operation being performed at each station.

It is yet another object of the present invention to provide, as well as a system for making, a prefabricated home module, as above, in which, at the end of said tracks, said module is completely assembled.

It is yet another object of the present invention to provide, as well as a system for making, a prefabricated home module, as above, including constructing upper story modules which can be assembled on top of a first story module.

It is yet another object of the present invention to provide, as well as a system for making, a prefabricated home module, as above, including transporting said modules to a home site and installing the modules thereon.

It is yet another object of the present invention to provide, as well as a system for making, a prefabricated home module, as above, in which prefabricated decks are added to the module at the home site.

It is yet another object of the present invention to provide, as well as a system for making, a prefabricated home module, as above, in which said modules as well as said prefabricated deck components are efficiently made, inexpensive, and are produced under quality control conditions.

These and other objects of the present invention will become apparent from the following description which sets forth the best mode and preferred embodiments of the invention.

In general, a non-installation site in situ process for making a prefabricated building module, comprises the steps of: providing a plurality of tracks, providing a support carrier, said carrier residing upon said tracks; assembling a plurality of trusses on said carrier; and connecting said trusses to form a modular base.

In general, a prefabricated building module, comprises: a module base, said module base containing a plurality of trusses, means for connecting said trusses together, and said module having been constructed on a carrier residing upon a track.

BEST MODE FOR CARRYING OUT THE INVENTION

According to the present invention, a method or system of assembling a prefabricated home module is provided. Briefly, the module is built at a noninstallation site on a truss base, in which the trusses are supported on a carrier. The carrier rides upon a pair of tracks. At the initial or commencement step of building the module, trusses are installed on a jig and rigidly spaced with regard to one another. The module is then generally placed on a carrier. Ducts are applied to the truss between the truss beam network. At another station, a floor is applied. At subsequent stations, the module is continued to be built with various components such as the walls being installed, the plumbing, the electrical, and the like being installed until the service module has been made and is complete and ready for transporting and installation upon a home site. At the home site, the module can be combined with other modules or with prefabricated deck modules such as floors and walls to form a home. If the home is a two-story home, a second module unit and/or prefabricated components are added on top of the first unit. All that generally needs to be installed at the home site is the roof and the utility hookups.

Figure 2:
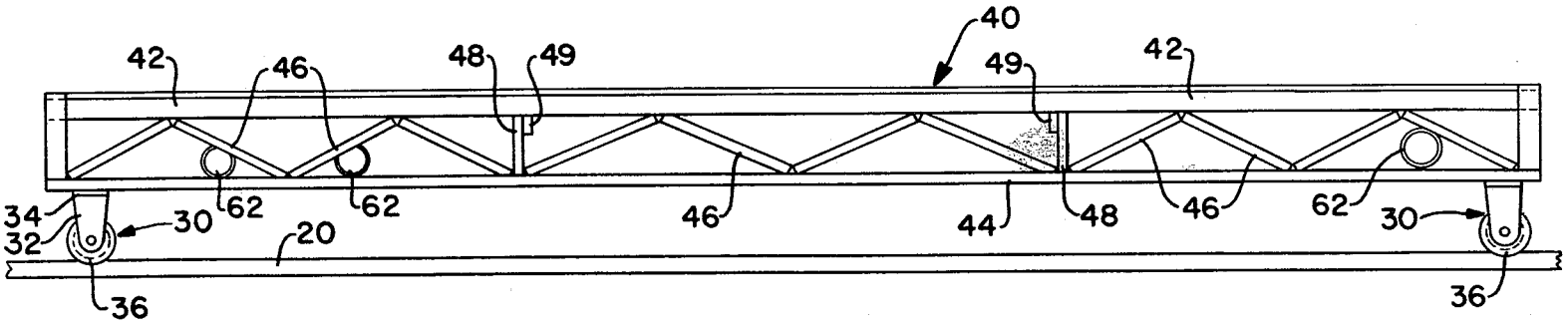
FIG. 2 is a side elevational view showing the service module floor and truss residing upon a carrier which, in turn, rides upon a track.
Figure 3:
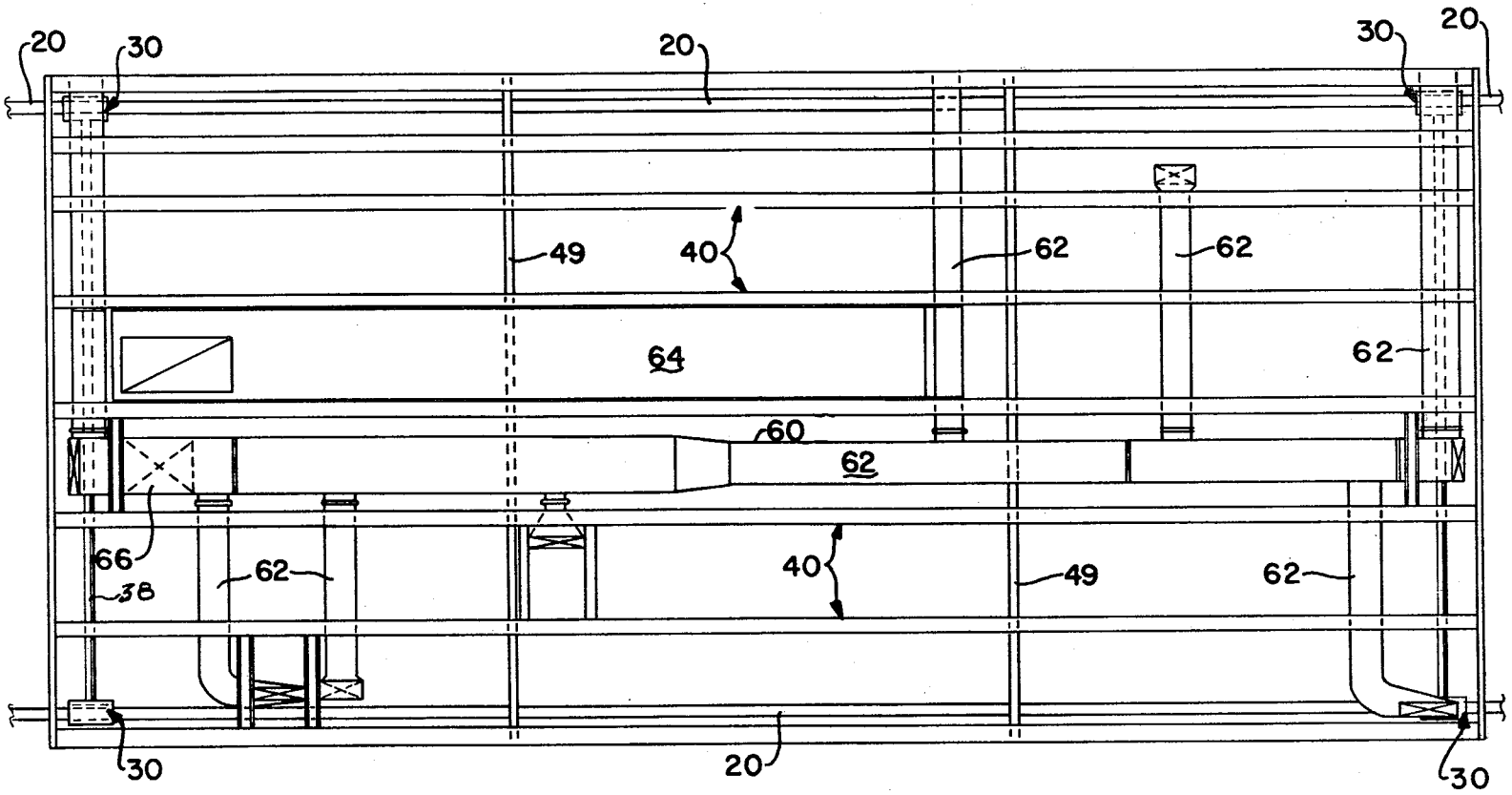
FIG. 3 is a top elevational view of an initially constructed module showing the trusses and ductwork.

Referring to FIG. 2, a track is generally indicated by the numeral 20. Although any plurality of tracks may be utilized, usually a pair of tracks is provided as shown in FIG. 3. Tracks 20 may be made out of steel or any conventional metal and of any shape. A pair of support carriers, generally indicated by the numeral 30, resides and rides upon track 20. The carriers have a body 32, a top support surface 34, and wheels 36 which engage track 20. As best shown in FIG. 3, the carriers contain a support beam 38 which extend from one track to the other and support the module thereon.

Figure 4:
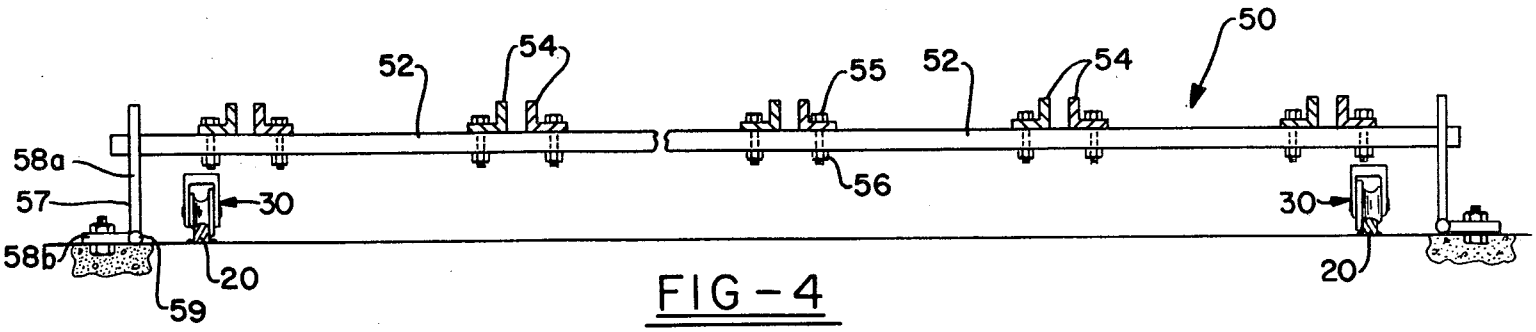
FIG. 4 is a side elevational view of a jig.

In order to easily and selectively space the trusses at exact distances from each other, a jig is provided. The jig, generally indicated by the numeral 50, is usually located at the beginning of the track and straddles the track. Generally, any number of jigs can be utilized per module, although typically only two are required, one at each end of the truss structures. Typically, the jigs may be of the structure shown in FIG. 4. Jig 50 has a support beam 52 with guide or positioning flanges 54 thereon. Typically, a fastening means such as a bolt 55 extends through the beam and flange, with the flange being secured to the beam by nut 56. Naturally, any number of positioning flanges may be located on the beam as at the desired number and location of the trusses utilized in the preparation of a module. Alternatively, numerous jigs may exist for various truss placements. The beam is supported by end support base leg 58*b* thereon. The arms pivot about point 59, so that once the trusses have been positioned upon beam 52 and connected to each other as through tie beams 49, support arm 58*a* is pivoted to the ground so that the connected trusses are lowered upon carriers 30. Then, the support beam 52 is moved out of the way, so as to not impair or block movement of the carriers upon tracks 20.

The trusses 40 are made out of wood and generally may be of any conventional type such as the Warren truss shown in FIG. 2. Each truss generally has a top wood beam 42 and a bottom wood beam 44 which are connected to each other by a series of angle beams 46. The attachment of each beam to each other can be accomplished in any conventional manner as through the use of nail plates (not shown). Occasionally along the length of the beam, the top beam and bottom beam are connected by vertical beam 48. In order to maintain an exact parallel relationship of the various trusses with regard to one another, as well as to obtain a rigid module base, tie beams or bridging beams 49 are provided and attached to the trusses. Generally, the truss components are made out of 2×4 lumber which is relatively inexpensive as compared to joist lumber, with the tie beams being made out of 2×6 lumber or 2×8. Generally, any number of truss beams can be installed or assembled with regard to the formation of a modular base structure, although the number of individual truss structures generally range from about 5 to about 10. Due to the use of trusses, this module units can be quite long, e.g., about 25 or 30 feet, although longer or shorter modules can be built.

Once trusses 40 have been positioned and connected with regard to one another, ductwork 60 may be added or installed therein. As apparent from FIG. 3, ducts 60 include hot air ducts 62 as well as cool air return ducts 64. The ducts may be positioned between adjacent trusses as well as extend therethrough as through the opening between top or bottom support beams 42 and 44, respectively, and angle beams 46 or vertical beams 48. The hot air duct may also include a connecting duct 66 which will directly reside over the hot air duct extending upwardly from a home furnace. Preferably, all the ductwork is located within service module 10 so that upon installation at a home site, no additional or costly ductwork need be installed. The ductwork, according to the present system, is conveniently installed and readily supported by the trusses.

Figure 5:
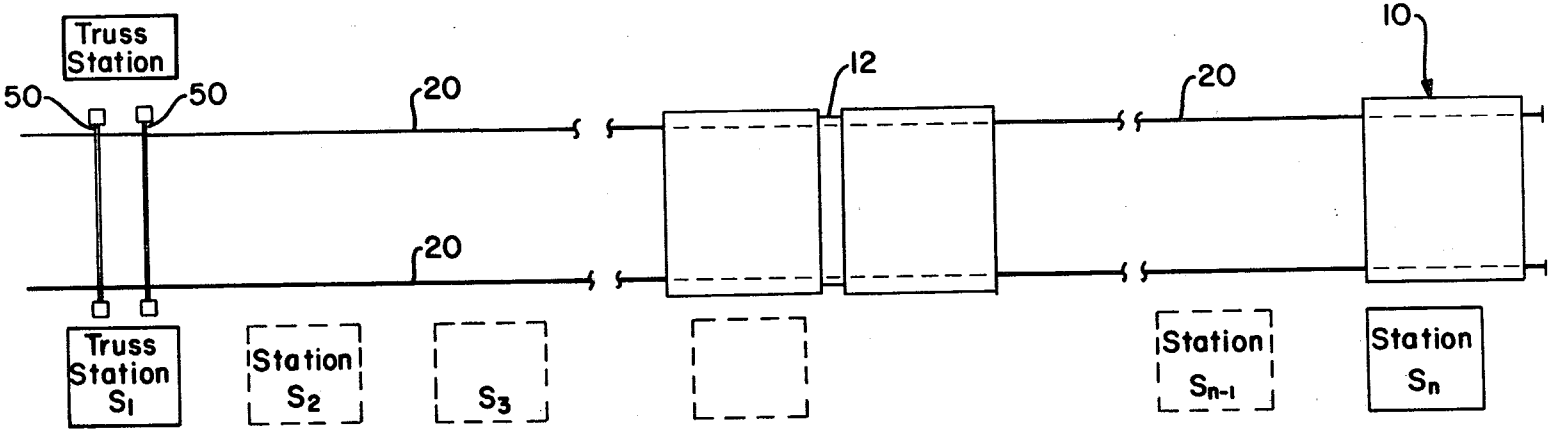
FIG. 5 is a schematic view of the trackway and of some of the stations there along.

During the phase of construction or preparation of the module, the trusses are moved along tracks 20 to a series of stations or construction sites, as shown in FIG. 5, wherein generally one or more different building operations are performed. Generally, the raw materials required for the construction of each particular stage are located along track 20 at the appropriate station so that a minimum distance for obtaining and assembling the raw materials into the module is required. For example, in the first stage, jigs 50 reside over traverse tracks 20. At this stage, trusses are assembled on the jigs and connected together, as set forth above. The base of module 10 is then lowered onto carriers 30 and the base module structure moved to another station, for example, Station $S_2$. The next operation may be carried out at Station $S_2$, as for example the application of ductwork to the base module. Upon completion, the module is moved to another station where various other items may be added such as the flooring. In a similar manner, the module is moved from station to station wherein wall framing, plumbing material, electrical wiring, floor finishing, wall finishing, cabinet work, ceiling material, and the like are all installed. As shown in FIG. 5, the supply stations containing the raw materials such as the plumbing, wiring, etc., may be located on either side of the track, although the material located on one side thereof is preferred. By this manner, the raw material is supplied to the module from one side of the track and the waste is discarded on the other side. The various modules may be connected to each other as through connecting rod 12. In such a manner, all the modules in their various stages of construction may be connected so that a train is formed. Thus, when it is time to move a module from one stage to the other, the lead module may simply be moved one station and all the other modules will accordingly be moved. The assembly of the module continues according to this process, station by station, being transferred down the tracks upon carriers 20 until the module is completed at the end of the track. From here, it is assembled on a vehicle such as a trunk and transported to the installation site. Naturally, the particular layout of the service module may vary greatly from one particular type of home to another or according to any suitable style. However, the service module 10 desirably contains a majority of all utilities such as the plumbing, wiring, and heating ducts. According to this method, the installation of such individual and piece meal items, which are generally added at the field, are eliminated, usually to a great cost savings.

Figure 1:
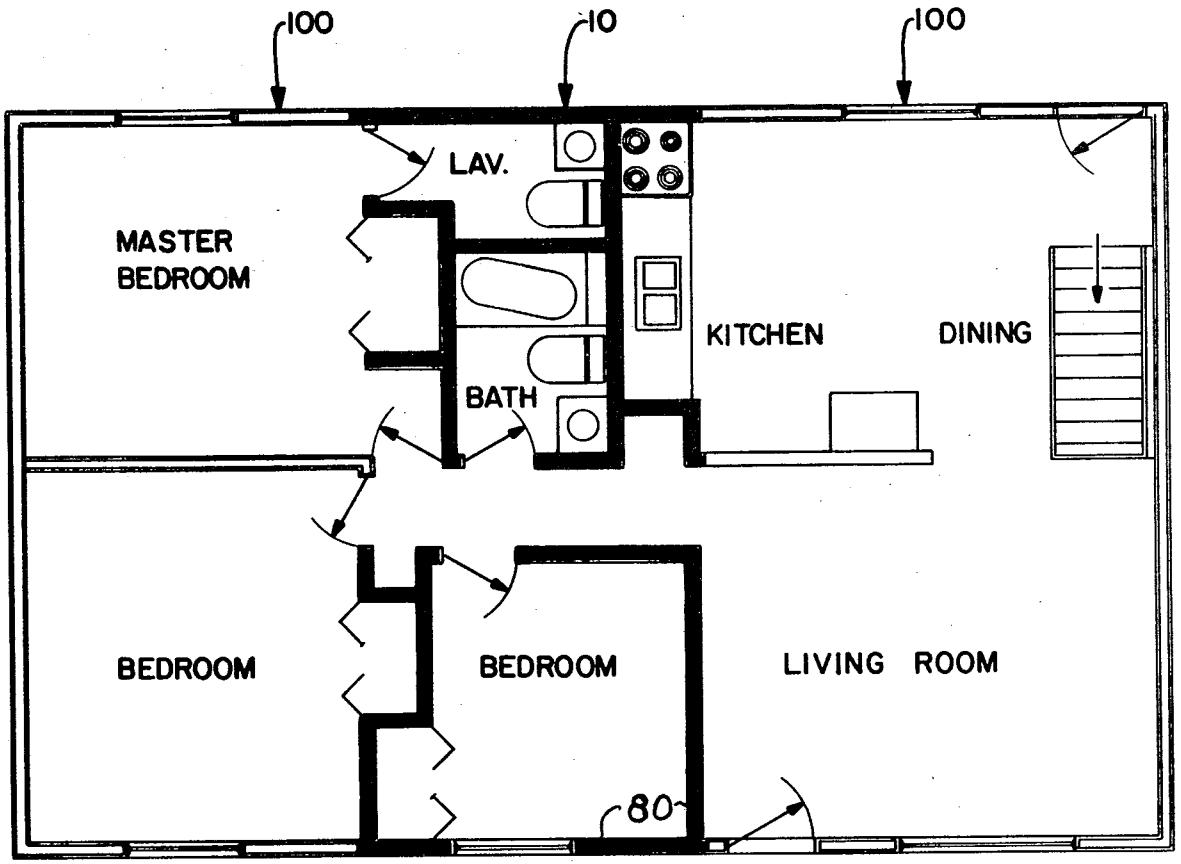
FIG. 1 is a top plan view of a ground floor unit showing a home having a service module constructed according to the process of the present invention, in combination with decks which utilize prefabricated components which were assembled and jointed to said service module.

In a similar manner as described above, other modules including adjoining side or deck modules, as well as top modules (that is, second floor modules), can be assembled and constructed. With regard to deck portions 100 of the home, the trusses and flooring thereon are constructed as a separate unit, with the various walls being prefabricated. The service module 10 is installed at the home location site. Then, the deck flooring unit is installed adjoining the service module on the home foundation and attached to the central service module. The prefabricated walls are then assembled and connected to the deck module. Ceilings are then added. In this manner, a home is assembled, as for example as shown in FIG. 1. Due to the use of trusses for the flooring supports, the need for footers, posts, and beam supports running along the bottom of the floors, usually along the central length of the home, are eliminated. All that is required is a roof to be added to the units and the construction of a home is complete. In a similar manner, a building, for example, a small office building can be constructed.

As apparent from FIG. 1, a typical assembly has deck units containing a general kitchen space, a dining room space, stairways to the basement, a living room, and two bedrooms. The service module contains a bedroom with closets, a linen closet, a hallway, two bathrooms, a kitchen sink area, and closets, as shown by the shaded walls 80. Although a specific room arrangement is shown, it is to be understood that generally any suitable room arrangement can be made according to the present invention with preferably the service module containing a majority of the plumbing, electrical wiring, heating ducts, and the like. All these components can be included without substantially increasing the module size. Moreover, according to the present invention, not only does the base module contain the various important elements of a home or building which require the most work and installation; that is, includes the plumbing, heating ducts, electrical work, lavatory and bath, kitchen sink and appliances, and the like, but also an ancillary unit as part thereof, such as for example a bedroom. The use of trusses which span a long distance permits the various utilities and structure to be assembled in the service module and leaves room for ancillary rooms to be built as a part thereof. Still further, it is noted that according to the present invention, the service module is not surrounded by walls, as typical with prior art modules, but once again due to the use of trusses for the supporting base has portions of the rooms open so that they expand into and are a part of other rooms, which are formed largely in part by the deck module, as shown in FIG. 1.

The method of assembly and construction of a service module unit as well as installation thereof with other prefabricated components is convenient, easy, and inexpensive. Since the work is done in a factory with all the materials being stockpiled, the high costs of outside labor is largely eliminated. Also, materials can be purchased on an original equipment basis, i.e., directly from the manufacturer, resulting in further savings to the customer. Since the work is done in a factory, rigid quality control standards can be enforced ensuring a high quality product. Quality is further enhanced because the worker is less likely to make errors since he is consistantly working on installing and/or fabricating the same components.

While in accordance with the patent statutes, only the best mode and preferred embodiment of the invention have been described in detail, it is to be understood that the invention is not limited thereto. Consequently, for an appreciation of the true scope and breadth of the invention, reference should be had to the appended claims.

What is claimed is:

1. A non-installation site in situ process for making a prefabricated building module, comprising the steps of:

(a) providing a plurality of tracks and a support carrier movably mounted upon said tracks;

(b) providing a movably mounted jig extending transversely across and spaced above the tracks and support carrier;

(c) selectively spacing a plurality of trusses from each other with the jig;

(d) providing a plurality of tie beams and connecting said tie beams between the spaced trusses to form a modular base;

(e) placing the modular base on the carrier by lowering the jig;

(f) moving the modular base along the tracks on the support carrier to various construction stations; and (g) adding additional components to the modular base at the various construction stations along the tracks to form a prefabricated home module.

2. The process defined in claim 1 in which the additional components added to the modular base include ductwork, wiring, plumbing, a floor and walls.

3. The process defined in claim 1 in which the jig is pivotally mounted on arms and supported above the tracks; and in which said arms are pivotally moved to lower the jig and place the modular base on the carrier.

4. The process defined in claim 1 in which the support carrier includes a plurality of top support surfaces mounted on wheels which engage the tracks; and in which said wheels and support surfaces are connected together by a support beam.

5. A process according to claim 1, including assembling a plurality of said base modules on said track, said base modules connected to each other, and moving said plurality of modules simultaneously along said track to the next construction stage upon completion of construction at a specific station.

* * * * *